US009136077B2

(12) United States Patent
Hu et al.

(10) Patent No.: US 9,136,077 B2
(45) Date of Patent: Sep. 15, 2015

(54) THREE-PHASE, MULTI-WAY VACUUM INTERRUPTER SWITCHGEAR WITH INTERNAL GROUND SWITCHES

(71) Applicant: Impact Power, Inc., Santa Ana, CA (US)

(72) Inventors: Kuang-Chien Hu, New Taipei (TW); Hsiu-Yun Yu, New Taipei (TW)

(73) Assignee: Impact Power, Inc., Santa Ana, CA (US)

( * ) Notice: Subject to any disclaimer, the term of this patent is extended or adjusted under 35 U.S.C. 154(b) by 301 days.

(21) Appl. No.: 13/927,758

(22) Filed: Jun. 26, 2013

(65) Prior Publication Data

US 2013/0292358 A1 Nov. 7, 2013

Related U.S. Application Data

(63) Continuation-in-part of application No. 13/087,321, filed on Apr. 14, 2011, now Pat. No. 8,658,931.

(60) Provisional application No. 61/664,606, filed on Jun. 26, 2012.

(51) Int. Cl.

| | |
|---|---|
| ***H01H 33/666*** | (2006.01) |
| ***H01H 33/42*** | (2006.01) |
| ***H01H 33/662*** | (2006.01) |

(Continued)

(52) U.S. Cl.

CPC ..... *H01H 33/42* (2013.01); *H01H 33/022* (2013.01); *H01H 33/666* (2013.01);

(Continued)

(58) Field of Classification Search

CPC ... H01H 33/666; H01H 33/42; H01H 33/022; H01H 33/66261

USPC ..... 218/5, 7–10, 12, 118–120, 136–140, 218/152–154

See application file for complete search history.

(56) References Cited

U.S. PATENT DOCUMENTS

| | | | | |
|---|---|---|---|---|
| 3,038,980 | A * | 6/1962 | Lee | 218/126 |
| 4,105,878 | A * | 8/1978 | Date et al. | 218/10 |
| 8,658,931 | B2 * | 2/2014 | Heller et al. | 218/120 |

*Primary Examiner* — Amy Cohen Johnson
*Assistant Examiner* — Marina Fishman
(74) *Attorney, Agent, or Firm* — Robert A. Seldon

(57) ABSTRACT

A three-phase vacuum interrupter switch assembly for power distribution systems comprises an outer case having at least one window and containing a plurality of component assemblies. The case interior is preferably free of oil and/or $SF_6$ gas. Each component assembly comprises three internal disconnect switch assemblies, three vacuum interrupter bottle switch assemblies and three ground switch assemblies. Each vacuum interrupter bottle switch is coupled in electrical series with a corresponding internal disconnect switch assembly. Because the open/closed state of a bottle switch is not directly observable owing to its sealed interior, a direct visible indication of the state of the three-phase vacuum interrupter switch assembly is provided by a visually detectable contact rod of the corresponding internal disconnect switch that is visible through the case window. To prevent potentially serious damage caused by arcing between the contacts of the internal disconnect switch, the internal disconnect switch is prevented from opening or closing when the bottle switches are closed.

When the component assembly is deactivated, some residual current may still remain. The ground switch assembly associated with the component assembly grounds such residual current as part of the deactivation process so that it is safe to have maintenance work performed. An interlocking mechanism ensures that the disconnect switch assembly, vacuum interrupter bottle switch assembly and ground switch assembly of each component assembly are opened and closed in a sequence that ensures proper and safe operation.

5 Claims, 18 Drawing Sheets

(51) Int. Cl.

| | |
|---|---|
| ***H01H 33/02*** | (2006.01) |
| *H01H 3/30* | (2006.01) |
| *H01H 9/26* | (2006.01) |
| *H01H 33/56* | (2006.01) |

(52) U.S. Cl.

CPC ..... *H01H 33/66261* (2013.01); *H01H 3/30* (2013.01); *H01H 9/26* (2013.01); *H01H 2033/566* (2013.01); *H01H 2033/6665* (2013.01); *H01H 2033/66246* (2013.01)

THREE-PHASE, MULTI-WAY VACUUM INTERRUPTER SWITCHGEAR WITH INTERNAL GROUND SWITCHES

FIELD OF THE INVENTION

The present invention pertains to current interrupting switchgear for power distribution systems. More particularly, the present invention relates to a three-phase, four-way, submersible loadbreak vacuum interrupter switchgear with internal ground switches for power distribution systems. More particularly, the present invention relates to a design that can be utilized to make three-phase, multi-way vacuum interrupter switchgear with internal ground switches for power distribution systems.

BACKGROUND

Electric utility power distribution systems are frequently constructed underground for a variety of reasons ranging from objections to the above-ground aesthetics, the premium of above-ground space in dense urban locations, and safety concerns. Accordingly, power distribution systems heretofore constructed of poles, wires, and pole-mounted switches and transformers are being superseded and even replaced by underground systems in underground "vaults".

In an electric utility power distribution system, switchgear is the combination of electrical disconnect switches, fuses or circuit breakers used to control, protect and isolate electrical equipment. Switchgear is used both to de-energize equipment to allow work to be done and to clear faults down the line. Switchgear is also used to distribute power to different areas within the system. Thus, this type of equipment is important to the distribution of reliable electricity within a power system.

The size and weight of three-phase switchgear govern their installation to on-surface or underground locations. While overhead space is relatively open and unrestricted, surface space is somewhat restricted and space in underground installations is more so and at a higher premium. Thus, switchgear have dimensional restrictions imposed on them, especially for underground installations. The size of a regular switchgear using only air as an insulating medium is quite large. In order to reduce size, oil or $SF_6$ gas was, and is, currently used in many switchgear. However, current environmental concerns discourage the use of these insulating medium. Oil and $SF_6$ gas can be flammable and/or explosive, and present environmental problems when leakage occurs and when emissions are created.

Three-phase, two-way, vacuum interrupter switchgear have been manufactured for use in power distribution systems. The common design of these switchgear is to entirely encapsulate the vacuum bottles in a polymeric material. This design does not allow an operator to visually confirm that the switchgear is in an "open" state and may not safely contain an explosion if the switchgear closes into a fault. These safety hazards were addressed in published U.S. Patent Application No. US-2011-0253675-A1 (the content of which is hereby incorporated by reference) by adding a disconnect switch with viewing window and by encasing the vacuum bottle assemblies within a sturdy stainless steel case. The addition of a viewing window and disconnect switch to the encapsulated design does not, however, address the potential explosion hazard if the switchgear were to close into a fault.

SUMMARY OF THE INVENTION

The present invention pertains to three-phase, multi-way submersible loadbreak vacuum interrupter switchgear designed to replace oil-insulated and $SF_6$ gas-insulated switchgear used in three-phase power distribution systems. Aside from the environmental safety aspects addressed by the elimination of oil and $SF_6$ gas, switchgear constructed in accordance with the present invention also address operational safety aspects by integrating ground switches and using interlocking operating mechanisms to ensure proper operating procedures. Moreover, the preferred component arrangement within switchgear thus constructed embodies a design that can be utilized to easily provide three-phase, multi-way (i.e., 2-way, 3-way, 4-way, 5-way, etc.) vacuum interrupter switchgear with internal ground switches.

Accordingly, a three-phase, multi-way submersible loadbreak vacuum interrupter switchgear is described which provides an internal ground switch and meets the dimensional constraints imposed by utility demands while providing the safety and ecological benefits of a vacuum interrupting switch.

When switchgear is "turned off", some residual current may still remain. Vacuum interrupter switch gear herein employs ground switch assemblies associated with the disconnect switch assembly and the vacuum bottle assembly to ground such residual current as part of the deactivation process so that it is safe to have maintenance work performed.

A ground can be external or made internal to the switchgear. When a ground switch assembly is built into the switchgear, an interlocking mechanism ensures that the deactivated disconnect switch assembly, deactivated vacuum interrupter bottle switch assembly and the corresponding ground switch assembly are switched in a sequence that ensures proper and safe operation. Conversely, the interlocking mechanism ensures that an activated disconnect switch assembly, activated vacuum interrupter bottle switch assembly and the corresponding ground switch assembly are switched in a sequence that ensures proper and safe operation. an interlocking mechanism can be used to force proper and safe operation.

By way of example, a 4-way submersible loadbreak vacuum interrupter switchgear is described and illustrated, but those of ordinary skill in the art will recognize that the number of "ways" may be more or less than 4 without departing from the scope of the invention; the preferred component configuration can in fact simply be repeated sufficiently to make three-phase multi-way switchgear with internal ground switches serving the desired number of branches. Switchgear constructed in accordance with the invention minimizes potential hazards such as oil and gas leakage and explosion in a populated surface location and/or within the confined space of an underground power distribution vault.

Other objects, advantages and significant features of the invention will become apparent from the following detailed description, which, taken in conjunction with the annexed drawings, discloses a preferred embodiment of the invention.

It will be understood that orientations described in this specification, such as "up", "down", "top", "side" and the like, are relative and are used for the purpose of describing the invention with respect to the drawings. Those of ordinary skill in the art will recognize that the orientation of the disclosed device can be varied in practice, and that the orientation used herein has been chosen for explanatory purposes only. Similarly, it will be recognized by those skilled in the art that the materials referred to herein, and particularly those identified by trademark, are examples of materials that meet the requirements and specifications mandated by safety concerns and by the use of the invention with electric power lines. Accordingly, other acceptable materials are within the scope of the invention whether known by generic names and/or other trademarks, or comprising other functionally equivalent material.

DETAILED DESCRIPTION OF THE PREFERRED EMBODIMENT

Figure 1:
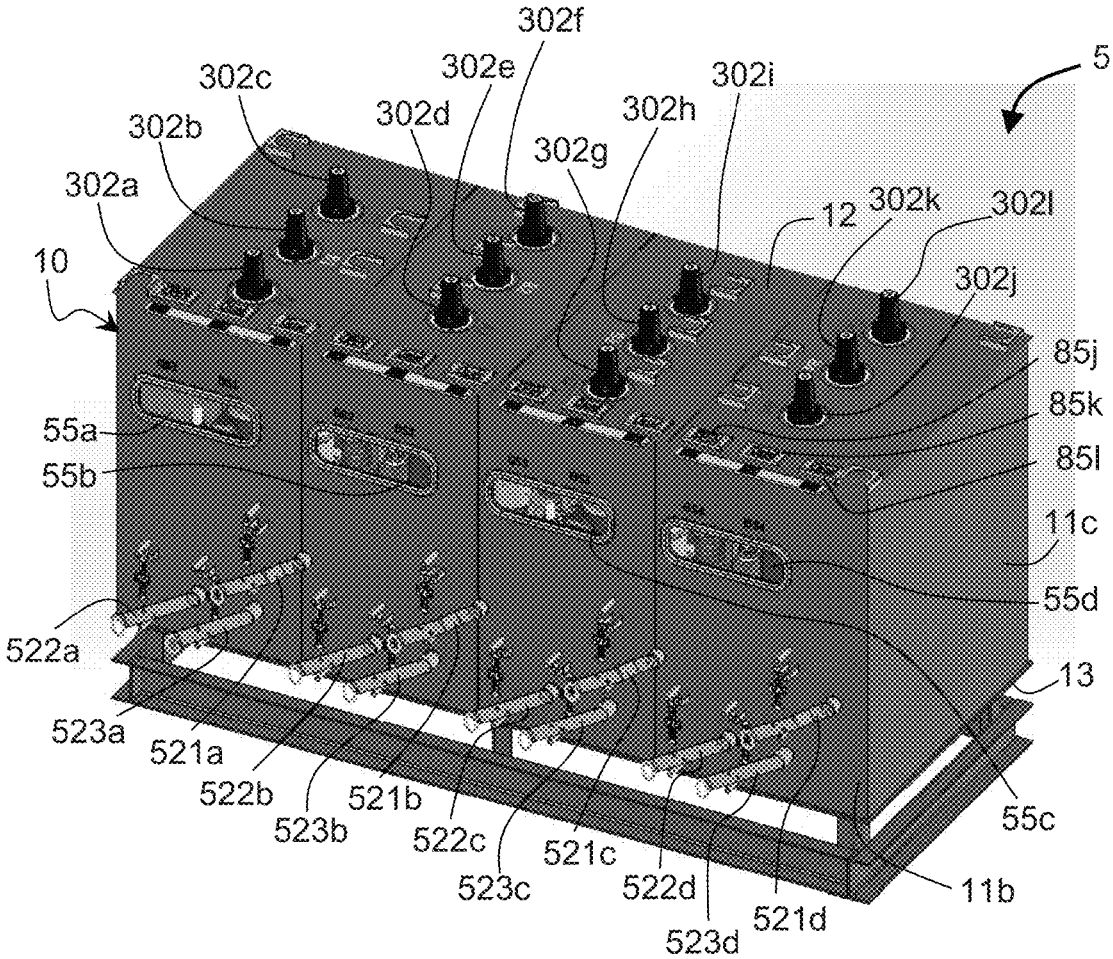
FIG. 1 is a right front perspective view of a preferred three-phase, four-way submersible loadbreak vacuum interrupter switchgear with internal ground switch constructed in accordance with the invention.

For the sake of brevity, it will be understood that a description of a component having an "a" suffix following its reference numeral will also serve as a description of a corresponding component having a "b", "c", "d", etc. suffix service unless otherwise stated in the specification or as evident from the Figures. Likewise, a set of three corresponding components may be referred to with the suffix "a-c", "d-f", "g-i", and "j-l" following the reference numeral. All corresponding components may be referred to, when appropriate, with the suffix denoting all the corresponding components following the reference numeral: e.g., "a-l".

The currently preferred vacuum interrupter bottle switch assemblies used in the preferred switchgear described herein are the same as the ones in published International Patent Application PCT WO 2009-108729 and the disconnect switch assemblies used are the same as the ones in published U.S. Patent Application No. US-2011-0253675-A1. The content of the foregoing two patent applications are hereby incorporated by reference and, thus, these assemblies will not be discussed in detail here for the sake of brevity.

Figure 2:
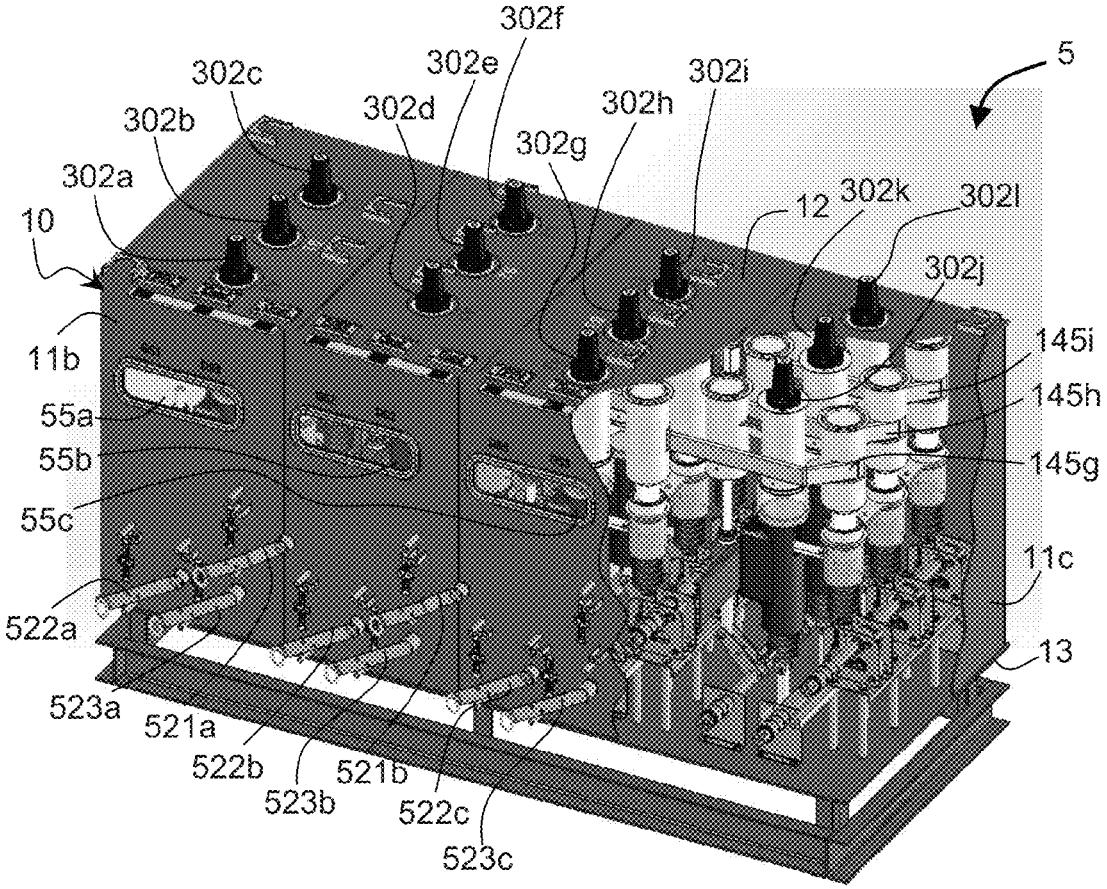
FIG. 2 is a right front perspective view of the three-phase, four-way submersible loadbreak vacuum interrupter switchgear with internal ground switch of FIG. 1, partially broken away to illustrate some internal components.

Referring to FIGS. 1 and 2, a currently preferred three-phase, four-way, submersible loadbreak vacuum interrupter switchgear with internal ground switch 5 constructed in accordance with the invention is illustrated. The switchgear comprises an outer case 10 formed from a sturdy, corrosive-resistant material. The preferred material is stainless steel. Switchgear case 10 is filled with dry air or nitrogen. Neither oil nor $SF_6$ gas is used. Case 10 preferably has left side 11*a* (not illustrated), front side 11*b*, right side 11*c*, and back side 11*d* (not illustrated), bottom 13, and cover 12 welded together along the abutting edges. Front side 11*b* has operating handles 521*a-d*, 522*a-d*, and 523*a-d*. Front side 11*b* also has viewing windows 55*a*, 55*b*, 55*c*, and 55*d*. As will become clear later, the viewing window permits personnel to view power interruption switches inside the sealed case in order to determine if the switches are open or closed. Four sets of three power bushings (302*a-c*, 302*d-f*, 302*g-i* and 302*j-l*) extend out from cover 12. Power bushings 302*a-c* extend up from the far left region of the cover, power bushings 302*d-f* extend from the near left region of the cover, power bushings 302*g-i* extend from the near right region of the cover, and power bushings 302*j-l* extend from the far right region of the cover. Bushing wells can be used in place of power bushings; however, power bushings are the preferred component for this invention. For ease of discussion, this description will refer to each of the foregoing "regions" as a "set". For example, one can see that there are four sets of power bushings: a first set of bushings 302*a-c*, a second set of bushings 302*d-f*, a third set of bushings 302*g-i* and a fourth set of bushings 302*j-l*. It will be understood that the sets could be defined by other combinations of bushings without departing from the scope of the invention. It will also be understood that outer case 10 is illustrated in FIGS. 1 and 2 with lines of demarcation visually separating adjacent "sets" of components, that each set is preferably identical in content and layout, and that the following description will be of the preferred arrangement. The lines of demarcation may or may not be present (in whole or in part) on switchgear constructed in accordance with the invention, and the sets may or may not be identical in content or layout, without departing from the scope of the invention.

Figure 3:
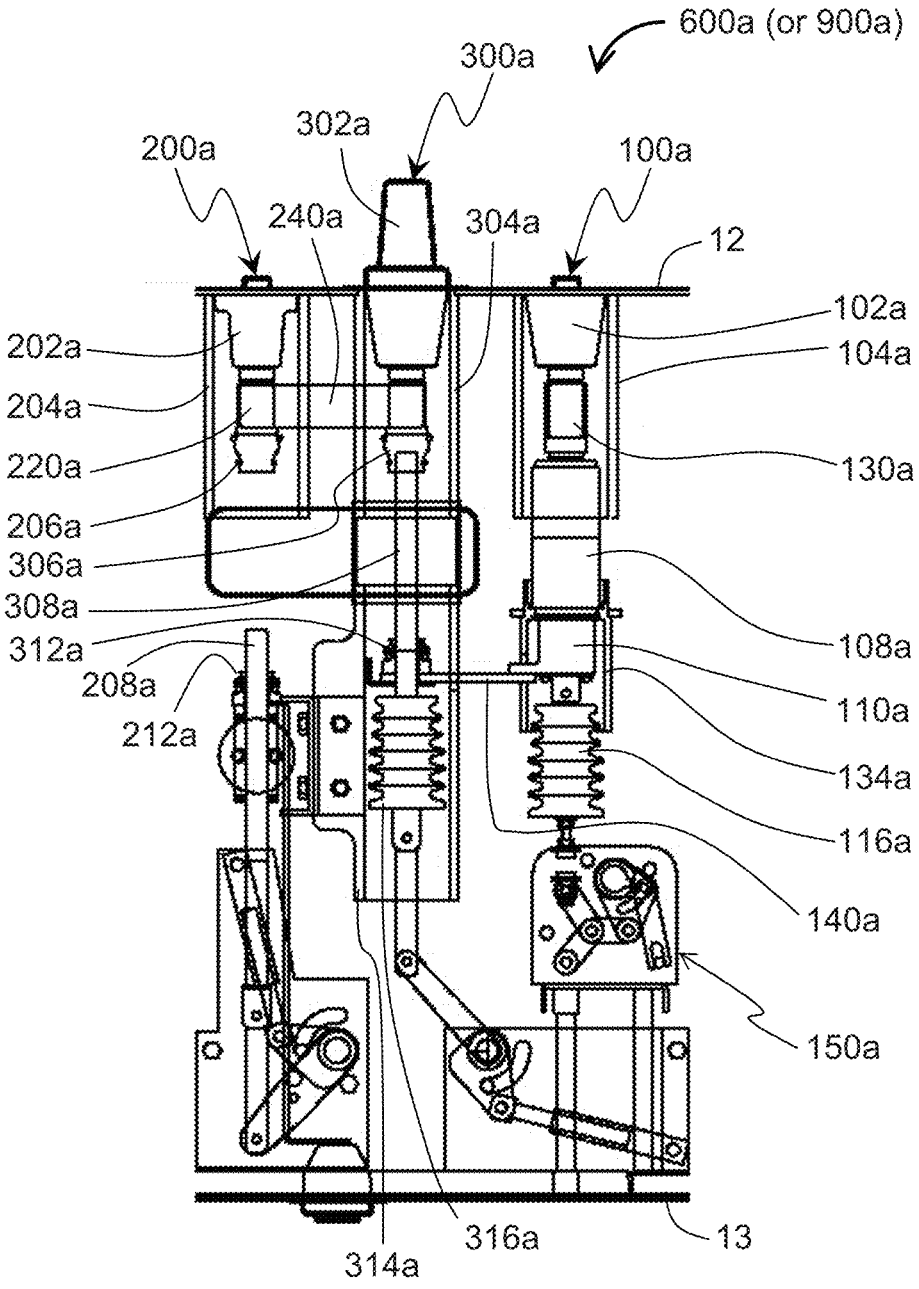
FIG. 3 is a cut-away front elevation view, in schematic, illustrating the internal layout of the ground switch, disconnect switch, and vacuum interrupter bottle switch assemblies in the preferred building block design of the invention.

FIG. 3 is a cut-away front elevation view illustrating the preferred layout of a single-phase building block module 600*a* which is composed of a ground switch assembly 200*a*, a disconnect switch assembly 300*a*, and a vacuum interrupter bottle switch assembly 100*a*. For ease of discussion, assemblies 200, 300, 100 and their components with suffixes "a", "d", "g", or "j" are considered "A Phase". Assemblies 200, 300, 100 and its components with suffixes "b", "e", "h", or "k" are considered "B Phase". Assemblies 200, 300, 100 and its components with suffixes "c", "f", "i", or "l" are considered "C Phase".

As used herein, the terms "building block" and "building block module" will be used as a convenient short-hand expression to denote a group of components whose configuration is repeated a number of times to form the preferred ground switch assembly. Those of ordinary skill in the art will recognize that the term does not necessarily connote the need for a separate housing for each building block, or the need for a visually identical subassembly from block to block, since the term is used in its conceptual sense only. As will be seen, the preferred embodiment of the invention uses visually identical building blocks within a single housing, but it should be noted that the invention is not limited to that preferred configuration.

Figure 4:
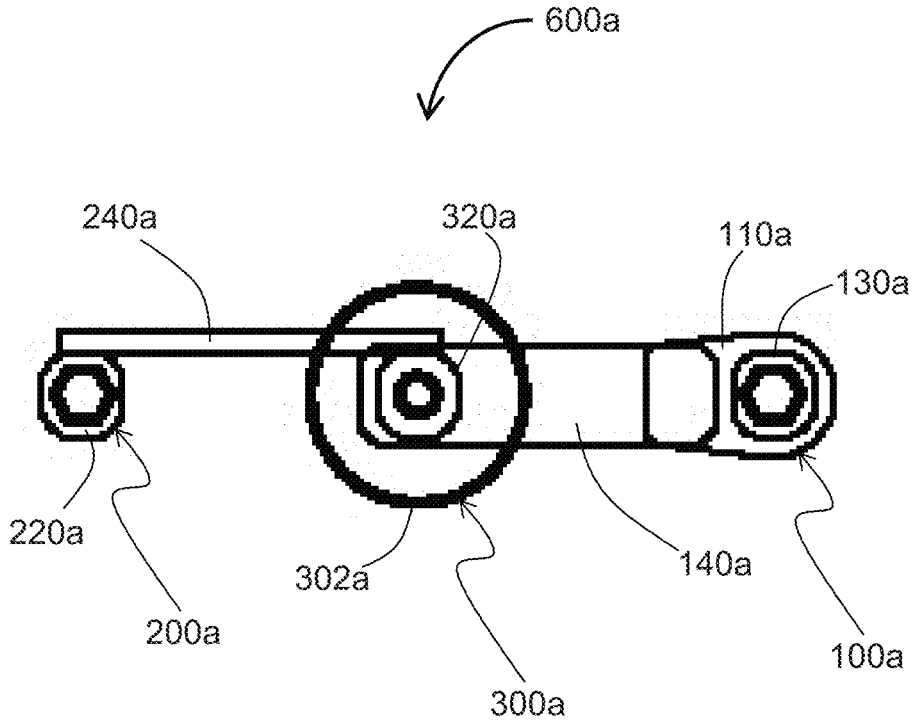
FIG. 4 is a top view, in schematic, of a single-phase building block of FIG. 3.

FIG. 4 is a top view of single-phase building block 600 which illustrates the mechanical and electrical coupling between ground switch assembly 200*a* and disconnect switch assembly 300*a* via connection bus 240*a*. FIG. 4 also illustrates the mechanical and electrical coupling between disconnect assembly 300*a* and vacuum interrupter bottle switch assembly 100*a* via connection bus 140*a*.

Figure 5:
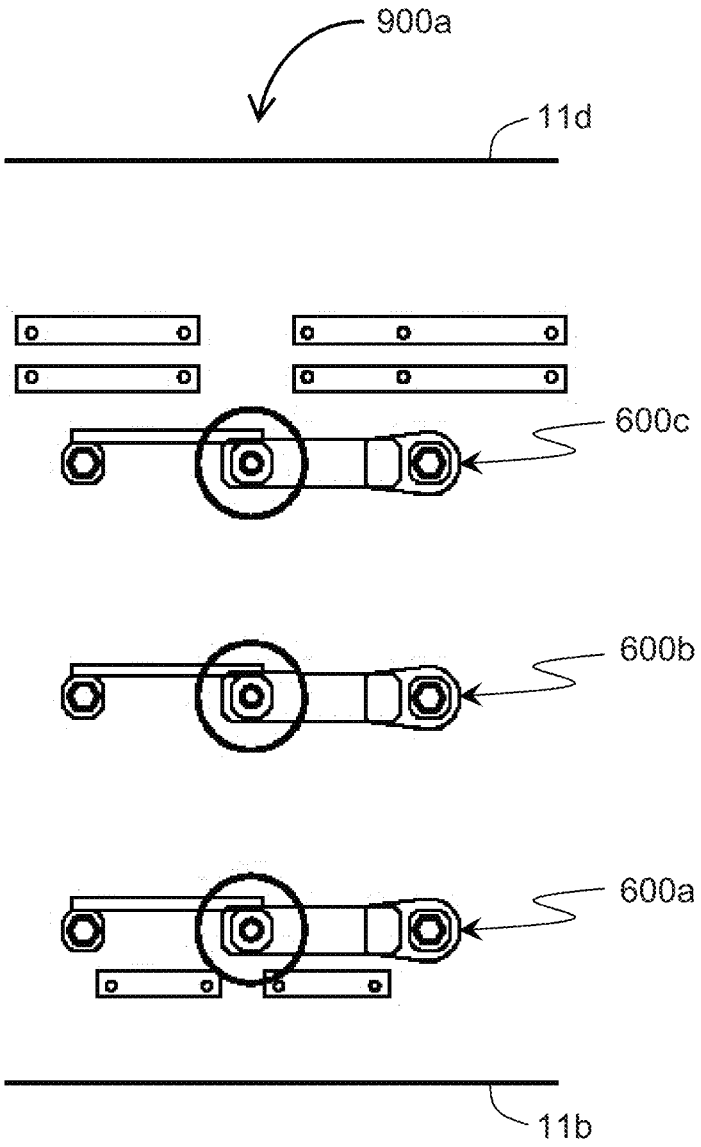
FIG. 5 is a top view, in schematic, of the three-phase building block design of FIG. 3.

To construct a three-phase building block module 900, a single-phase building block module 600*b* extends vertically upward and out of cover 12 behind single-phase building block module 600*a* and generally parallel thereto. A single-phase building block module 600*c* extends vertically upward and out of cover 12 behind single-phase building block module 600*b* and generally parallel thereto. This is best illustrated in FIG. 5 which is a cut-building away top view illustrating the preferred layout of the building blocks 600*a-c* for a three-phase block 900*a*. A front elevation view for a three-phase building block 900*a* would be the same as illustrated in FIG. 3. For ease of discussion, when two or more three-phase building blocks 900 are referenced in the design, the one designated 900*a* will be considered the "input power" block or "feeder" block and the remaining will be considered as distribution blocks.

Figure 6:
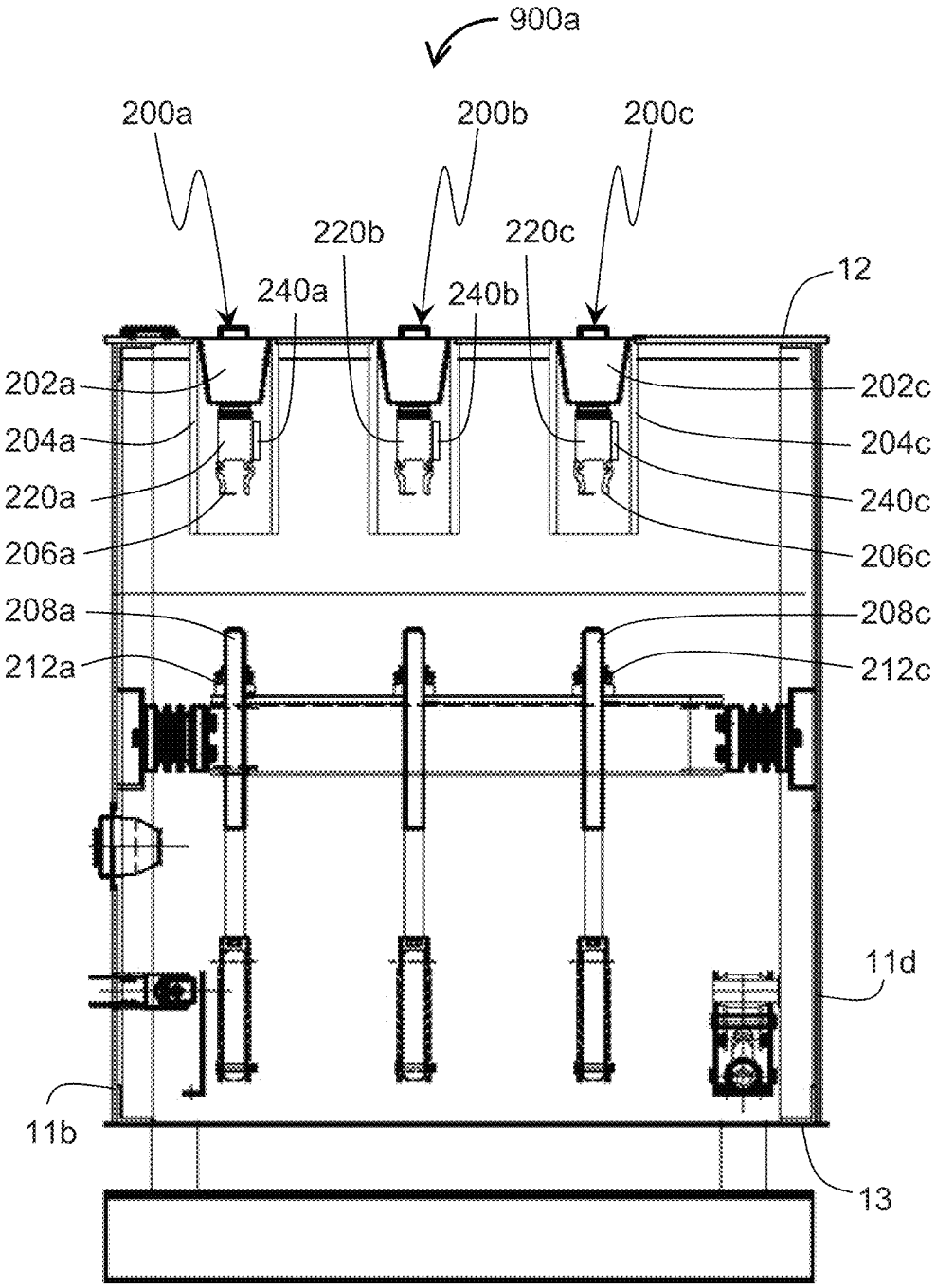
FIG. 6 is a cut-away right side elevation view, in schematic, of the building block design of FIG. 3, illustrating the internal layout of the ground switch assembly components.

FIG. 6 is a cut-away right side elevation view of the three-phase building block design 900*a* of FIG. 3, illustrating the preferred internal layout of the ground switch assemblies 200*a-c*. As illustrated in FIGS. 3 and 6, ground switch assembly 200*a-c* is generally comprised of an insulator 202*a-c*, an insulating shield 204*a-c*, a connector 220*a-c*, a top contact 206*a-c*, a bottom contact 212*a-c*, and a contact rod 208*a-c*. Ground switch assembly 200*a* extends vertically upward and out of cover 12. Ground switch assembly 200*b* extends vertically upward and out of cover 12 behind ground switch assembly 200*a* and generally parallel thereto. Ground switch assembly 200*c* extends vertically upward and out of cover 12 behind ground switch assembly 200*b* and generally parallel thereto. The ground switch assemblies 200*a-c* are connected to a ground bus which in turn is connected to a ground terminal where a ground cable/wire is attached to the switchgear during installation. Grounding occurs when contact rods 208*a-c* are pushed up and into top contacts 206*a-c*. Ground switch assemblies 200*a-c* are mechanically and electrically coupled to disconnect switch assemblies 300*a-c* via connection buses 240*a-c* and function to ground the electrical components within the building block design 900*a* so that no residual current remains.

Figure 7:
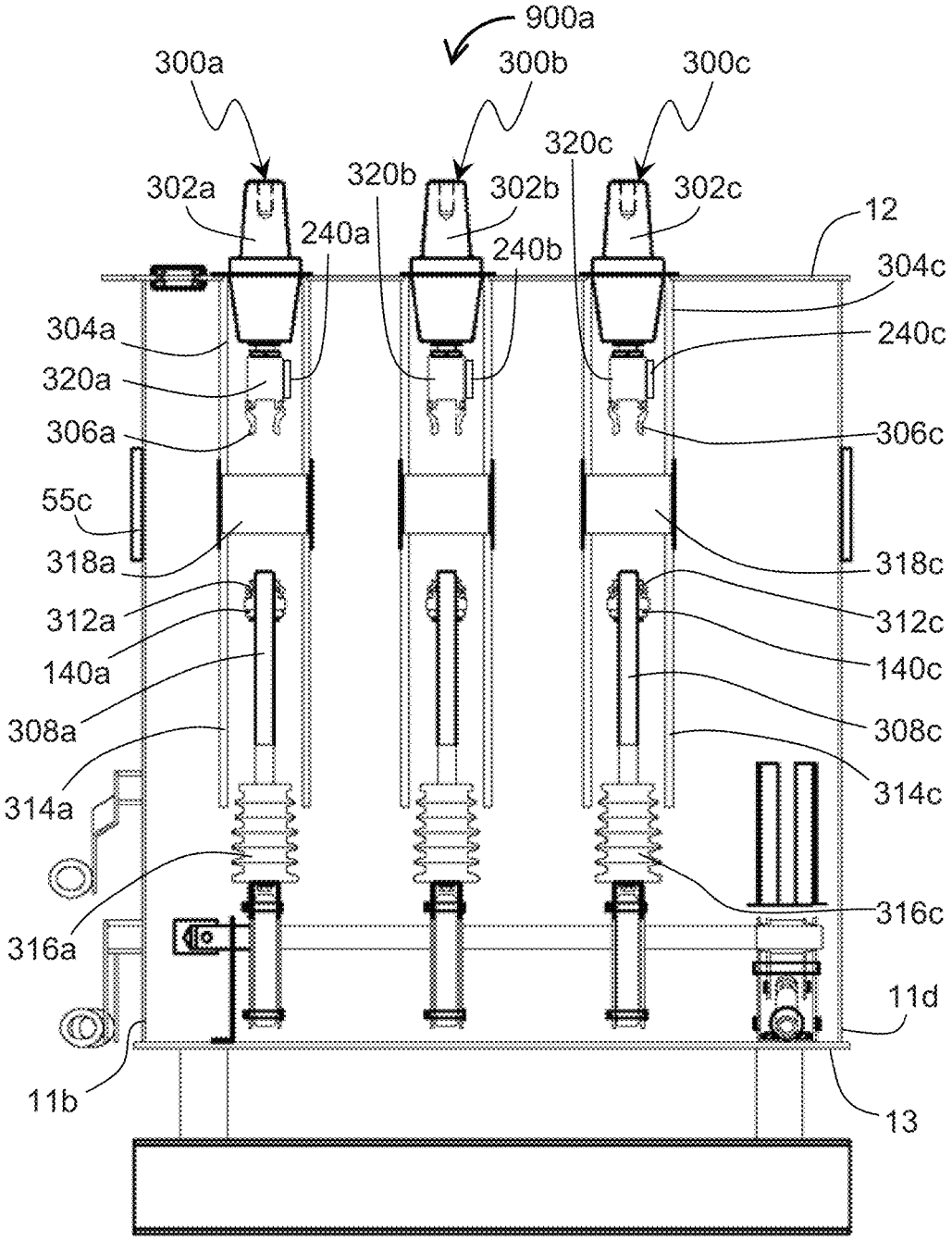
FIG. 7 is a cut-away right side elevation view, in schematic, of the building block design of FIG. 3, illustrating the internal layout of the disconnect switch assembly components.

FIG. 7 is a cut-away right side elevation view of the three-phase building block design 900*a* of FIG. 3, illustrating the preferred internal layout of the disconnect switch assemblies 300*a-c*. As illustrated in FIGS. 3 and 7, disconnect switch assembly 300*a-c* is generally comprised of a power bushing 302*a-c*, an insulating shield 304*a-c*, a transparent insulating shield 318*a-c*, a connector 320*a-c*, top contact 306*a-c* and bottom contact 312*a-c*, a contact rod 308*a-c*, an insulating shield 314*a-c*, and a push-pull insulator 316*a-c*. Disconnect switch assembly 300*a* extends vertically upward and out of cover 12. Although, for reasons that will be understood by those of ordinary skill in the art, the disconnect switch can be made without a transparent insulating shield, the preferred embodiment utilizes one for increased safety purposes.

Disconnect switch assembly 300*b* extends vertically upward and out of cover 12 behind disconnect switch assembly 300*a* and generally parallel thereto. Disconnect switch assembly 300*c* extends vertically upward and out of cover 12 behind disconnect switch assembly 300*b* and generally parallel thereto. Disconnect switch assemblies 300*a-c* function to allow power to either enter or exit each building block design 900*a*. Besides being connected to ground switch assemblies 200*a-c*, disconnect switch assemblies 300*a-c* are also mechanically and electrically coupled to vacuum interrupter bottle switch assemblies 100*a-c* via connection buses 140*a-c*.

Figure 8:
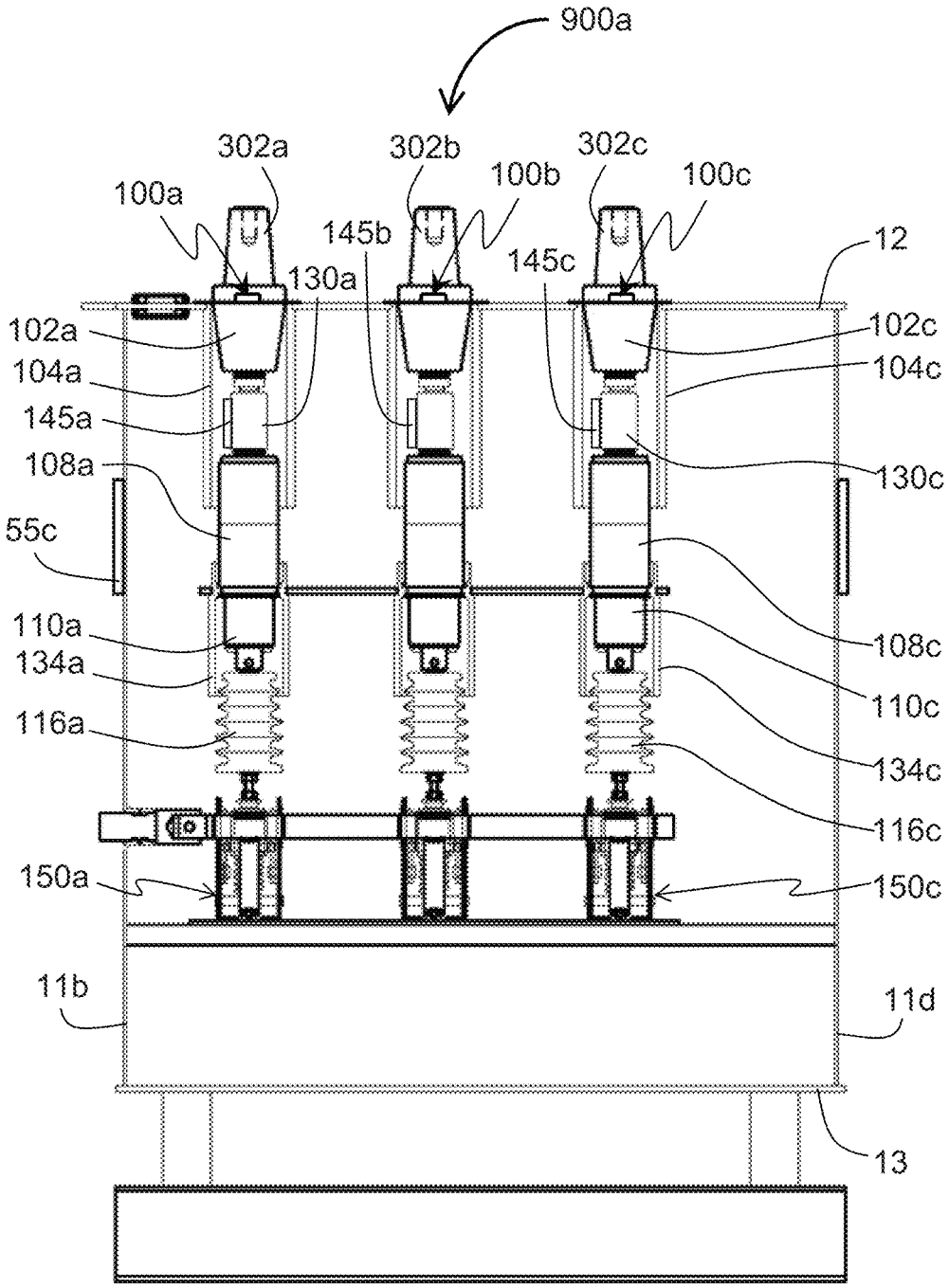
FIG. 8 is a cut-away right side elevation view, in schematic, of the building block design of FIG. 3, illustrating the internal layout of the vacuum interrupter bottle assembly components.

FIG. 8 is a cut-away right side elevation view of the three-phase building block design 900*a* of FIG. 3, illustrating the preferred internal layout of the preferred vacuum interrupter bottle switch assemblies 100*a-c*. As illustrated in FIGS. 3 and 8, vacuum interrupter bottle switch assembly 100*a-c* is generally comprised of a mounting insulator 102*a-c*, an insulation shield 104*a-c*, a top connector 130*a-c*, a vacuum interrupter bottle switch 108*a-c*, a common bus connector 110*a-c*, an insulation shield 134*a-c*, a push-pull insulator 116*a-c*, and an operating mechanism assembly 150*a-c*. Vacuum interrupter bottle switch assembly 100*a* extends vertically upward and out of cover 12. Vacuum interrupter bottle switch assembly 100*b* extends vertically upward and out of cover 12, behind vacuum interrupter bottle switch assembly 100*a* and generally parallel thereto. Vacuum interrupter bottle switch assembly 100*c* extends vertically upward and out of cover 12, behind vacuum interrupter bottle switch assembly 100*b* and generally parallel thereto. Vacuum interrupter bottle switch assemblies 100*a-c* function to connect power to or break load from three-phase building block designs 900 which are connected to 900*a* via connection buses 145.

Figure 9:
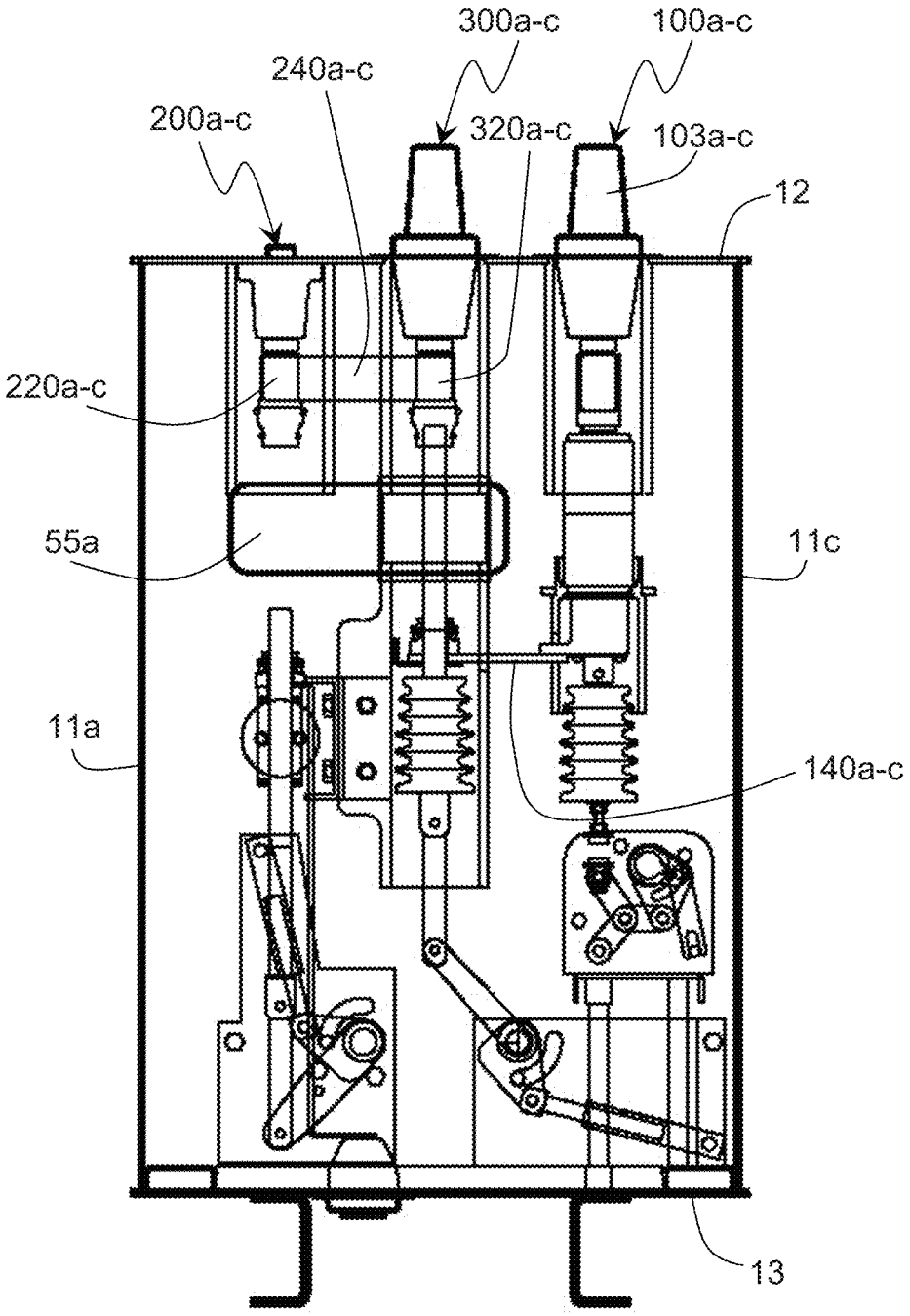
FIG. 9 is a front elevation view, in schematic, illustrating a preferred design of a three-phase, two-way submersible loadbreak vacuum interrupter switchgear with internal ground switch.

FIG. 9 is a cut-away front elevation view of a preferred design for a three-phase, two-way submersible loadbreak vacuum interrupter switchgear with internal ground switch based on the current invention. This preferred design uses only one three-phase building block 900*a* comprised of ground switch assembly 200*a-c*, disconnect switch assembly 300*a-c*, and vacuum interrupter bottle switch assembly 100*a-c*. Mounting insulator 102*a-c* of vacuum interrupter bottle switch assembly 100*a-c* is replaced with a power bushing 103*a-c*. This is the preferred design and results in a compact switchgear. A three-phase, two-way submersible loadbreak vacuum interrupter switchgear can be constructed using two three-phase building blocks 900, but would be twice the size of the preferred design. Bushing wells can also be used instead of power bushings; however, the preferred modification is to use power bushings.

Figure 10:
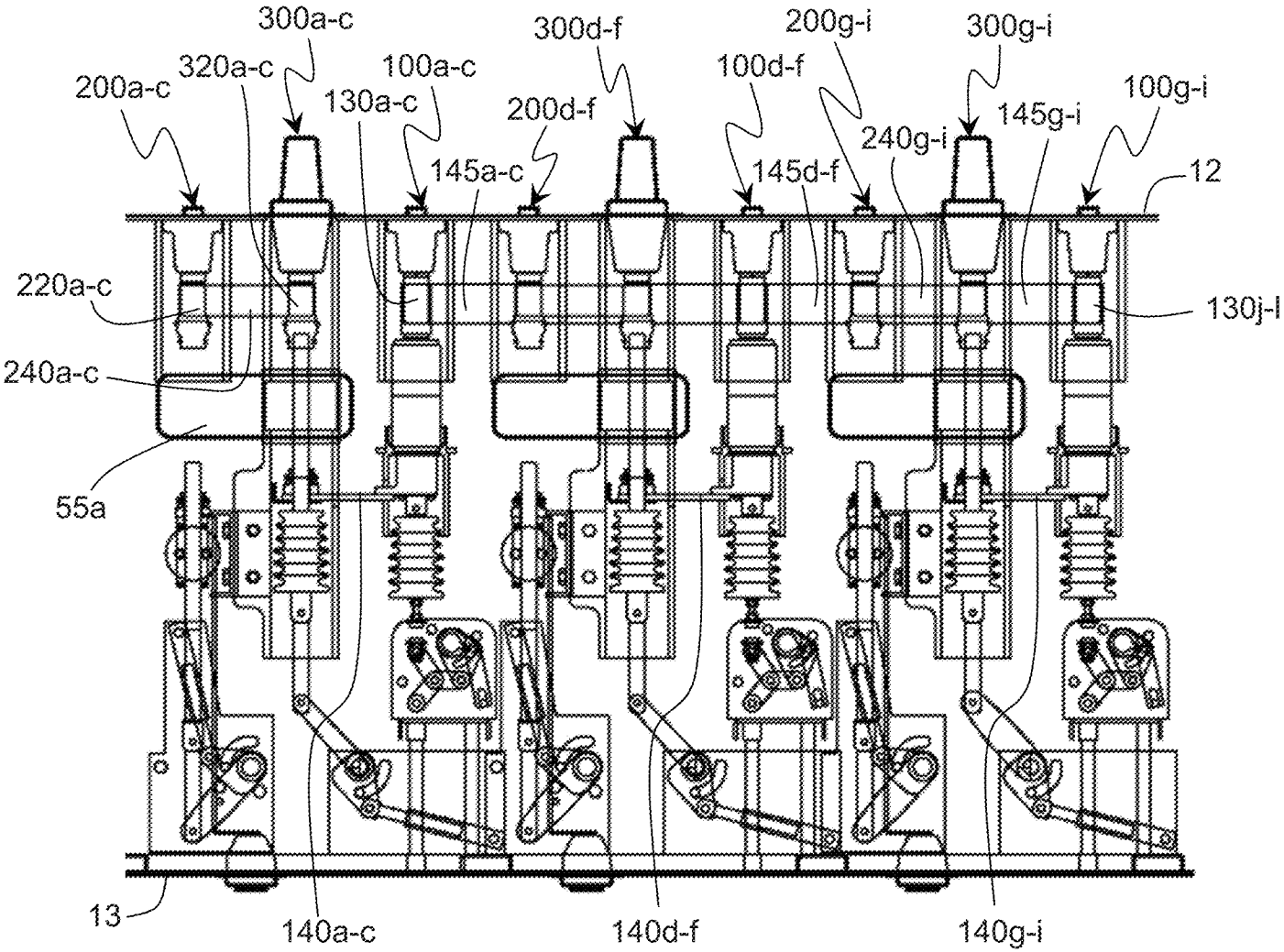
FIG. 10 is a cut-away front elevation view, in schematic, of a three-phase, three-way submersible loadbreak vacuum interrupter switchgear with internal ground switch based on FIGS. 3 and 8, illustrating the internal layout of components for the ground switch, disconnect switch and vacuum interrupter bottle switch assemblies.
Figure 11:
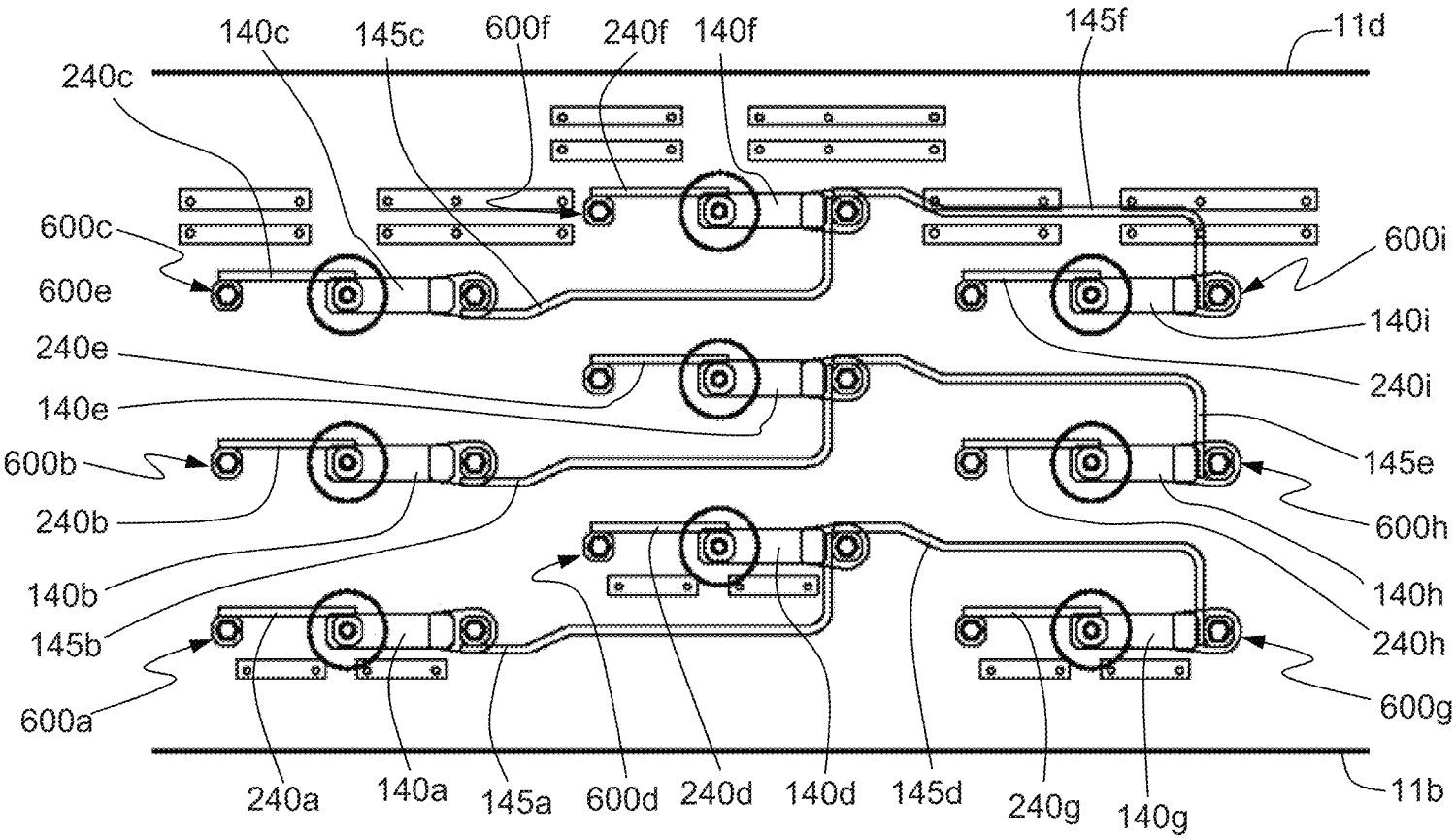
FIG. 11 is a cut-away top plan view, in schematic, of a three-phase, three-way submersible loadbreak vacuum interrupter switchgear with internal ground switch of FIG. 10, illustrating the internal layout of components for the ground switch, disconnect switch and vacuum interrupter bottle switch assemblies.

When expanding to a three-phase, three-way submersible loadbreak vacuum interrupter switchgear with internal ground switch as illustrated in FIG. 10, building block modules 900*a*, 900*b*, and 900*c* are positioned staggered to one another as best illustrated in FIG. 11. Referring to FIGS. 10 and 11, each phase (A, B, and C) is electrically coupled in series with connection buses 145. A-Phase building block 600*a* is coupled mechanically and electrically to A-Phase building block 600*d* with connection bus 145*a* at vacuum interrupter bottle assembly connector 130*a* and 130*d*, respectively. A-Phase building block 600*d* is coupled mechanically and electrically to A-Phase building block 600*g* with connection bus 145*d* at vacuum interrupter bottle assembly connector 130*d* and 130*g*, respectively. The same connections are made for B-Phase building blocks 600*beh* via connection buses 145*b* and 145*e* and C-Phase building blocks 600*cfi* via connection buses 145*c* and 145*f*.

Figure 12:
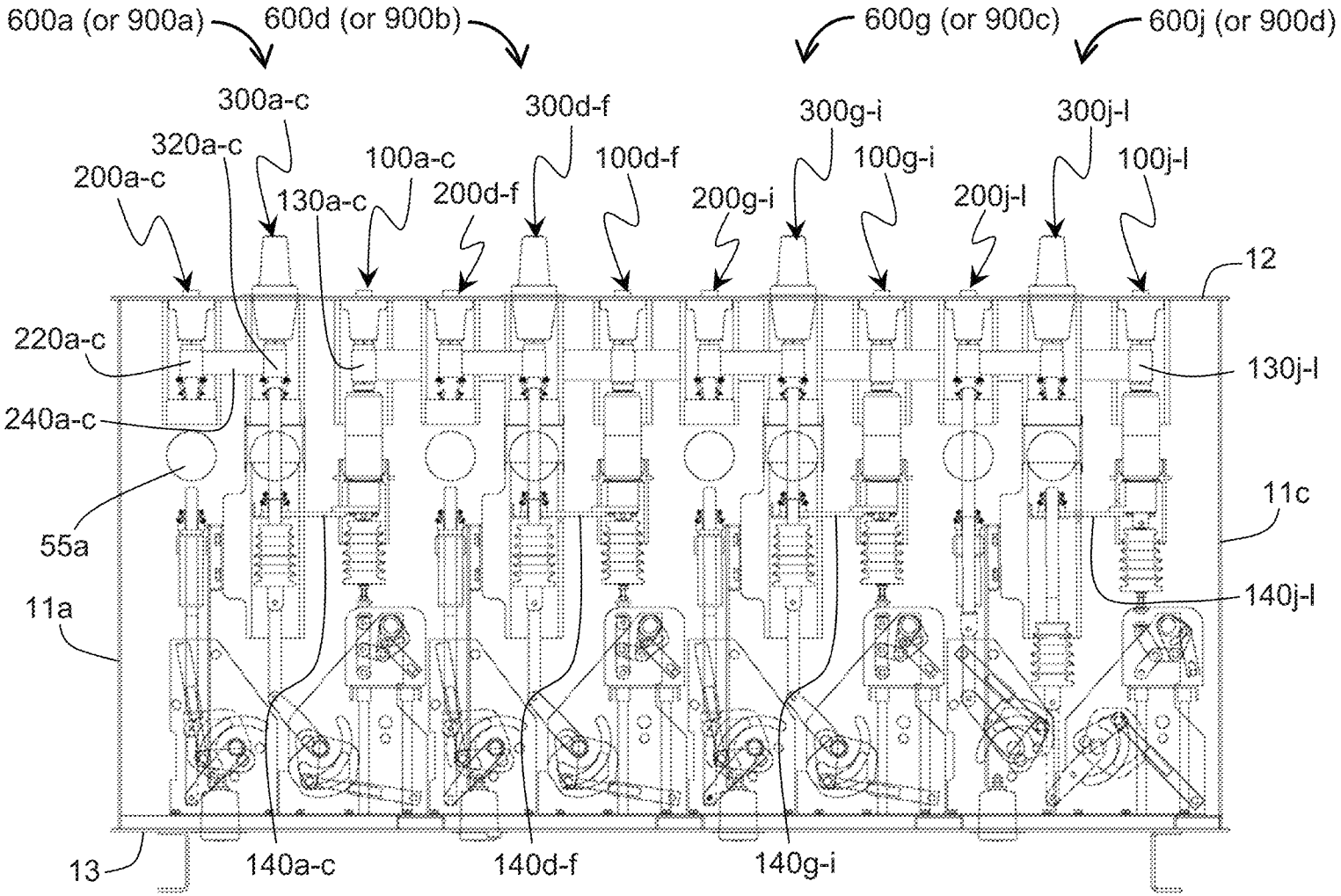
FIG. 12 is a cut-away front elevation view, in schematic, of the three-phase, four-way submersible loadbreak vacuum interrupter switchgear with internal ground switch of FIG. 1, illustrating the internal layout of components for the ground switch, disconnect switch and vacuum interrupter bottle switch assemblies.

FIG. 12 is a cut-away front elevation view, in schematic, of the preferred switchgear of FIG. 1. As illustrated in FIG. 12, disconnect switch assemblies 300*a-l* are mechanically and electrically coupled to ground switch assemblies 200*a-l* through connection buses 240*a-l* at connectors 320*a-l* and 220*a-l*, respectively. Vacuum interrupter bottle switch assemblies 100*a-l* are mechanically and electrically coupled to disconnect switch assemblies 300*a-l* through connection buses 140*a-l*.

Figure 13:
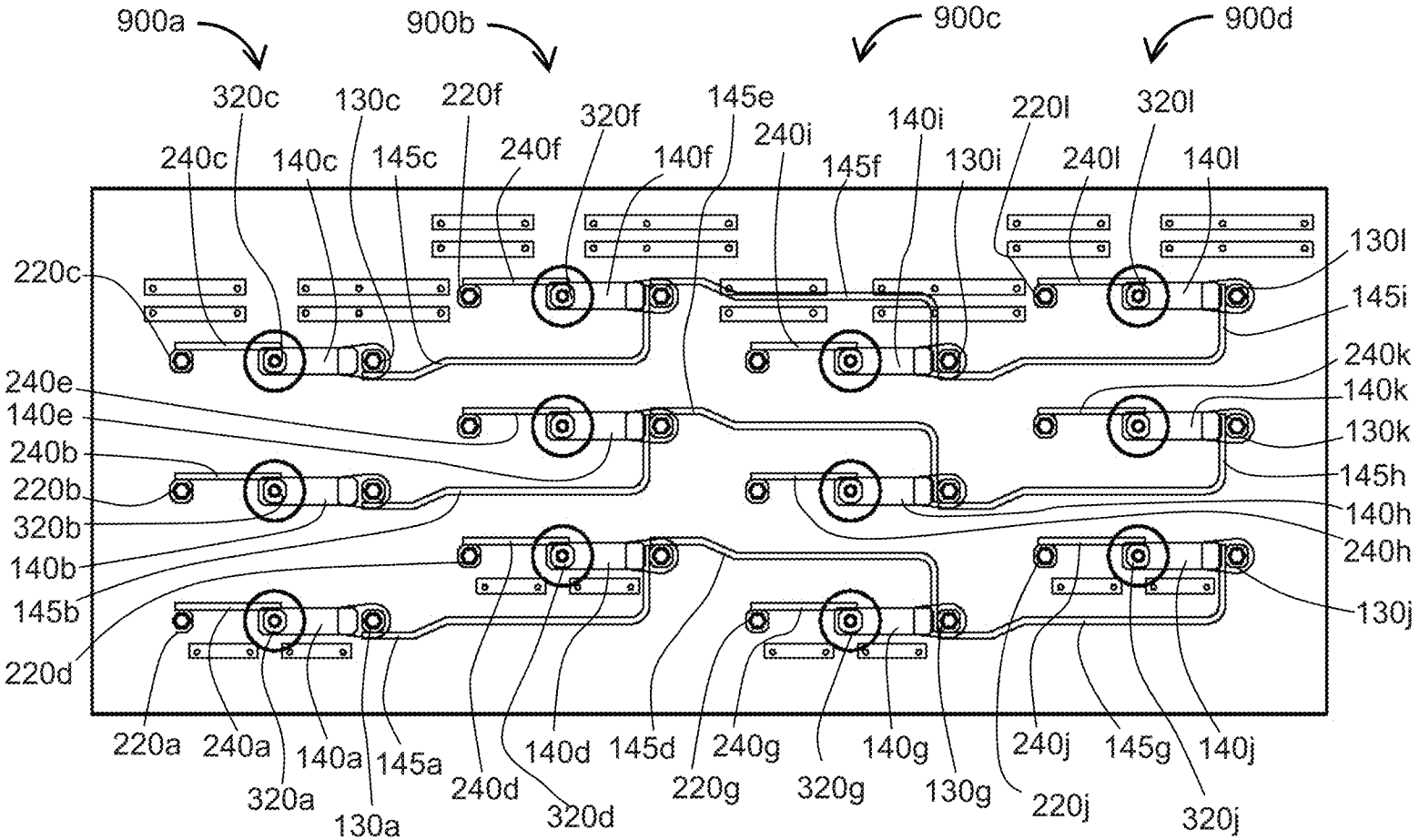
FIG. 13 is a cut-away top view, in schematic, of the three-phase, four-way submersible loadbreak vacuum interrupter switchgear with internal ground switch of FIG. 12, illustrating the internal layout of connection buses to the ground switch, disconnect switch and vacuum interrupter bottle switch assemblies.

FIG. 13 is a cut-away top elevation view of the preferred switchgear of FIG. 1, in schematic, and best illustrates the internal layout of connection buses 140*a-l*, 240*a-l*, and 145*a-i* to the ground switch assemblies 200*a-l*, disconnect switch assemblies 300*a-l*, and vacuum interrupter bottle switch assemblies 100*a-l*. Disconnect switch assemblies 300*a-l* are mechanically and electrically coupled to ground switch assemblies 200*a-l* through connection buses 240*a-l* at connectors 320*a-l* and 220*a-l*, respectively. Vacuum interrupter bottle switch assembly 100*a* is mechanically and electrically coupled to vacuum interrupter bottle switch assembly 100*d* through connection buses 145*a* at connectors 130*a* and 130*d*, respectively. Vacuum interrupter bottle switch assembly 100*d* is mechanically and electrically coupled to vacuum interrupter bottle switch assembly 100*g* through connection buses 145*d* at connectors 130*d* and 130*g*, respectively. Vacuum interrupter bottle switch assembly 100*g* is mechanically and electrically coupled to vacuum interrupter bottle switch assembly 100*j* through connection buses 145*g* at connectors 130*g* and 130*j*, respectively. The same connection method is repeated for vacuum interrupter bottle switch assemblies 100*b* to 100*e* to 100*h* to 100*k* at connectors 130*b*, 130*e*, 130*h*, and 130*k*, respectively, via connection buses 145*b*, 145*e*, and 145*h*. This connection method is also repeated for vacuum interrupter bottle switch assemblies 100*c* to 100*f* to 100*i* to 100*l* at connectors 130*c*, 130*f*, 130*i*, and 130*l*, respectively, via connection buses 145*c*, 145*f*, and 145*i*.

Figure 14:
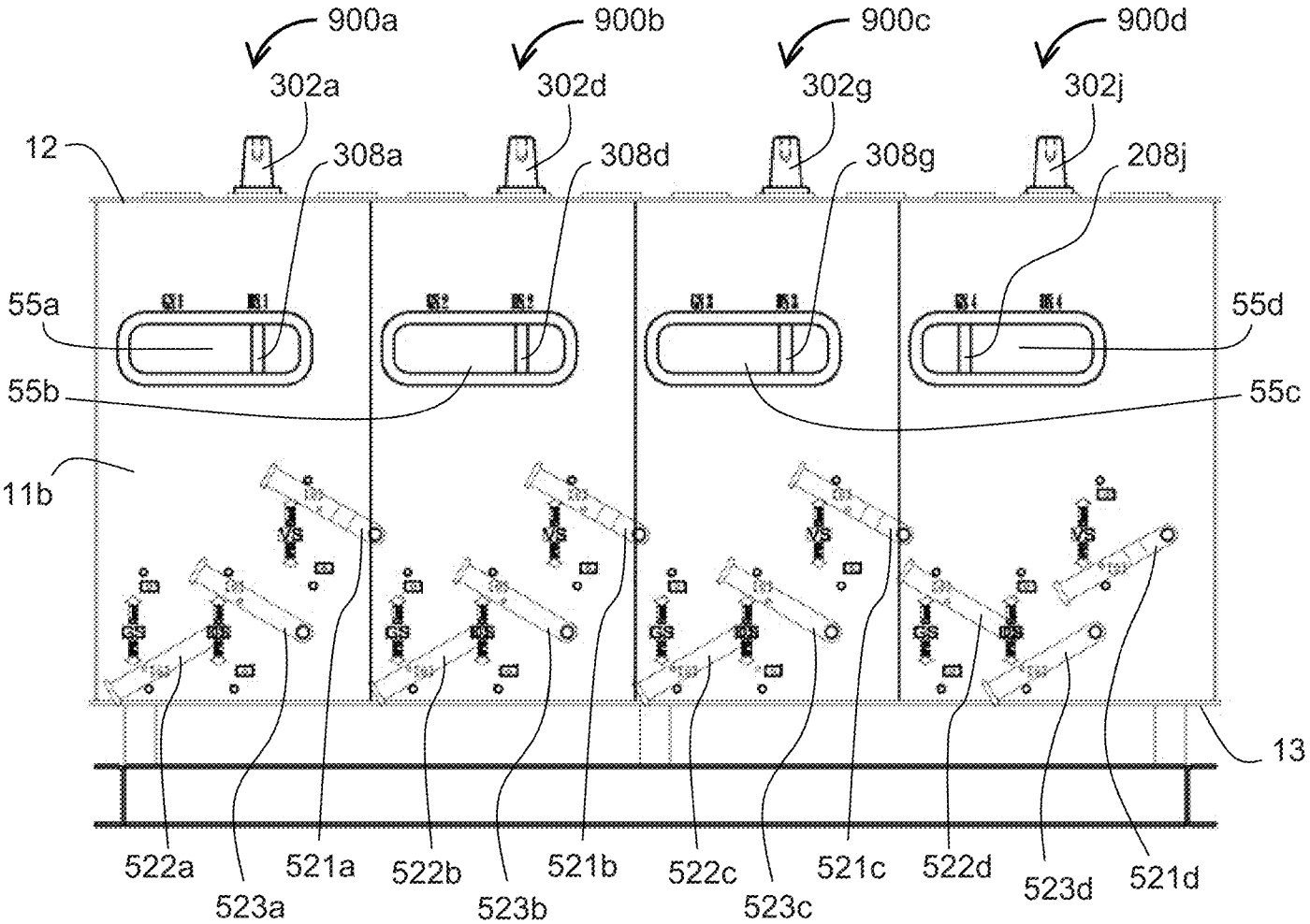
FIG. 14 is a front elevation view, in schematic, of the three-phase, four-way submersible loadbreak vacuum interrupter switchgear with internal ground switch of FIG. 12, illustrating the viewing windows and positions of the handles and rods for the ground and disconnect switches.

FIG. 14 is a front elevation view of the preferred switchgear of FIG. 1 in schematic, illustrating the viewing windows 55*a-d* and positions of the operating handles of the ground switch, disconnect switch, and vacuum interrupter switch assemblies. All operating handles have "open" and "closed" positions. In the preferred design, the open positions have the operating handles pointed in a downward "8 o'clock" direction. The closed positions have the operating handles pointed in a "10 o'clock" direction. The operating handles rotate in a clockwise direction to change from the open to closed position. The operating handles rotate in a counterclockwise direction to change from the closed to open position. As illustrated in FIG. 14, operating handles 521*a-c*, 522*d*, and 523*a-c* are in the closed position. Operating handles 521*d*, 522*a-c*, and 523*d* are in the open position. As illustrated, when disconnect switch handles 523*a-c* are in the closed position, disconnect contact rods 308*a-c*, 308*d-f*, 308*g-i* can be seen through viewing windows 55*a*, 55*b*, and 55*c*, respectively. With disconnect switch handle 523*d* in the open position, disconnect contact rods 308*j-l* are not seen in viewing window 55*d*. As illustrated, when ground switch handles 522*a-c* are in the open position, ground contact rods 208*a-c*, 208*d-f*, 208*g-i* cannot be seen through viewing windows 55*a*, 55*b*, and 55*c*, respectively. With ground switch handle 522*d* in the closed position, ground contact rods 208*j-l* are seen in viewing window 55*d*. With the handles in the positions illustrated, three-phase building blocks 900*a*, 900*b*, and 900*c* are in the closed position and ready for operation. Three-phase building block 900*d* is in the open position, grounded, and not in operation.

Figure 15:
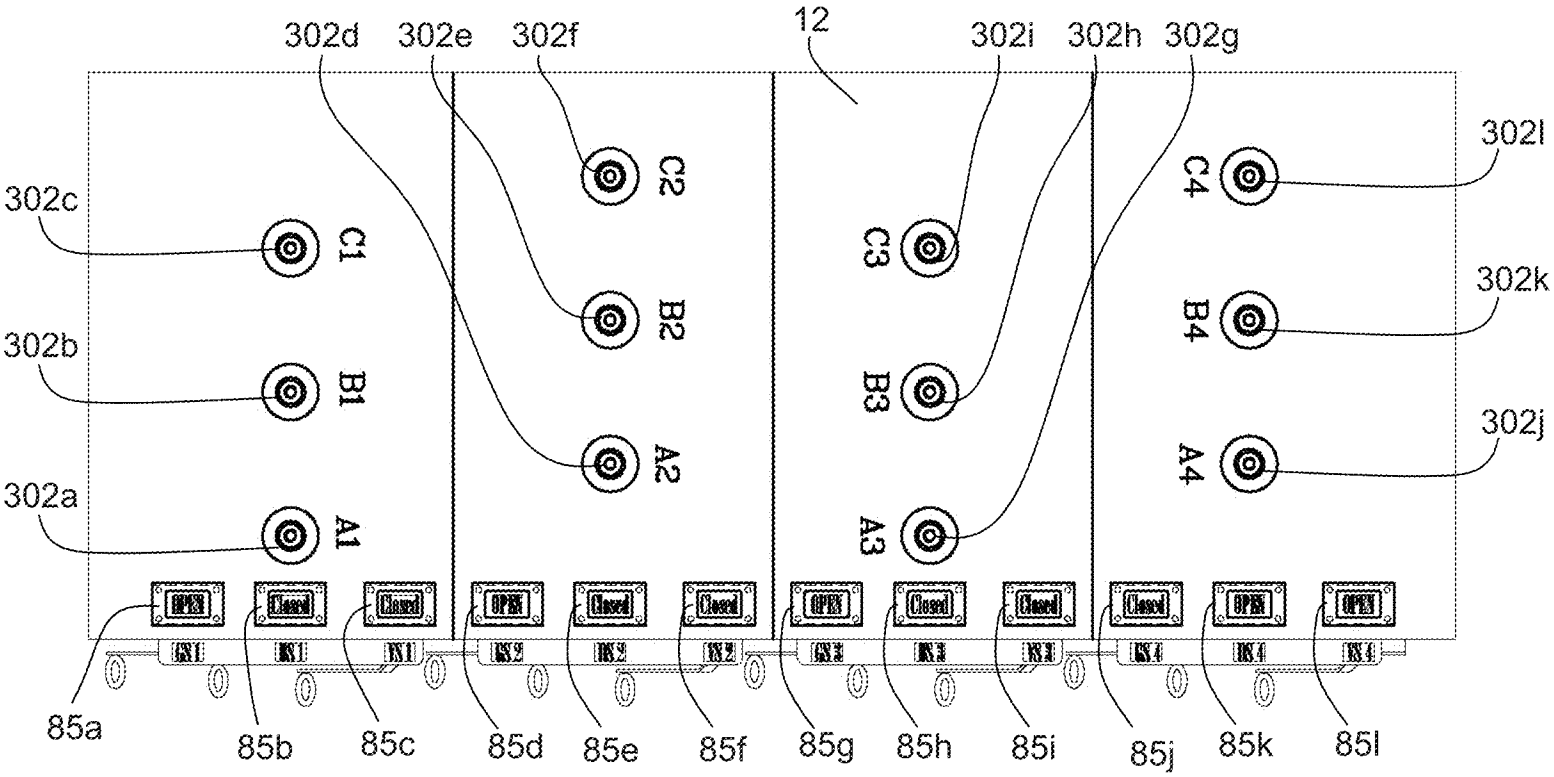
FIG. 15 is a top elevation view, in schematic, of the three-phase, four-way submersible loadbreak vacuum interrupter switchgear with internal ground switch of FIG. 14, illustrating the switch status indicators.

FIG. 15 is a top elevation view of the described invention and best illustrates the positions of power bushings 302*a-l* of disconnect switch assemblies 300*a-l* and switch status indicators 85*a-l* on cover 12. Switch status indicators 85*a*, 85*d*, 85*g*, and 85*j* show the open or closed status for ground switch assemblies 200*a-c*, 200*d-f*, 200*g-i*, and 200*j-l*, respectively. Switch status indicators 85*b*, 85*e*, 85*h*, and 85*k* show the open or closed status for disconnect switch assemblies 300*a-c*, 300*d-f*, 300*g-i*, and 300*j-l*, respectively. Switch status indicators 85*c*, 85*f*, 85*i*, and 85*l* show the open or closed status for vacuum interrupter bottle switch assemblies 100*a-c*, 100*d-f*, 100*g-i*, and 100*j-l*, respectively. These indicators show switch status to an operator who is viewing the switchgear from above.

Figure 16:
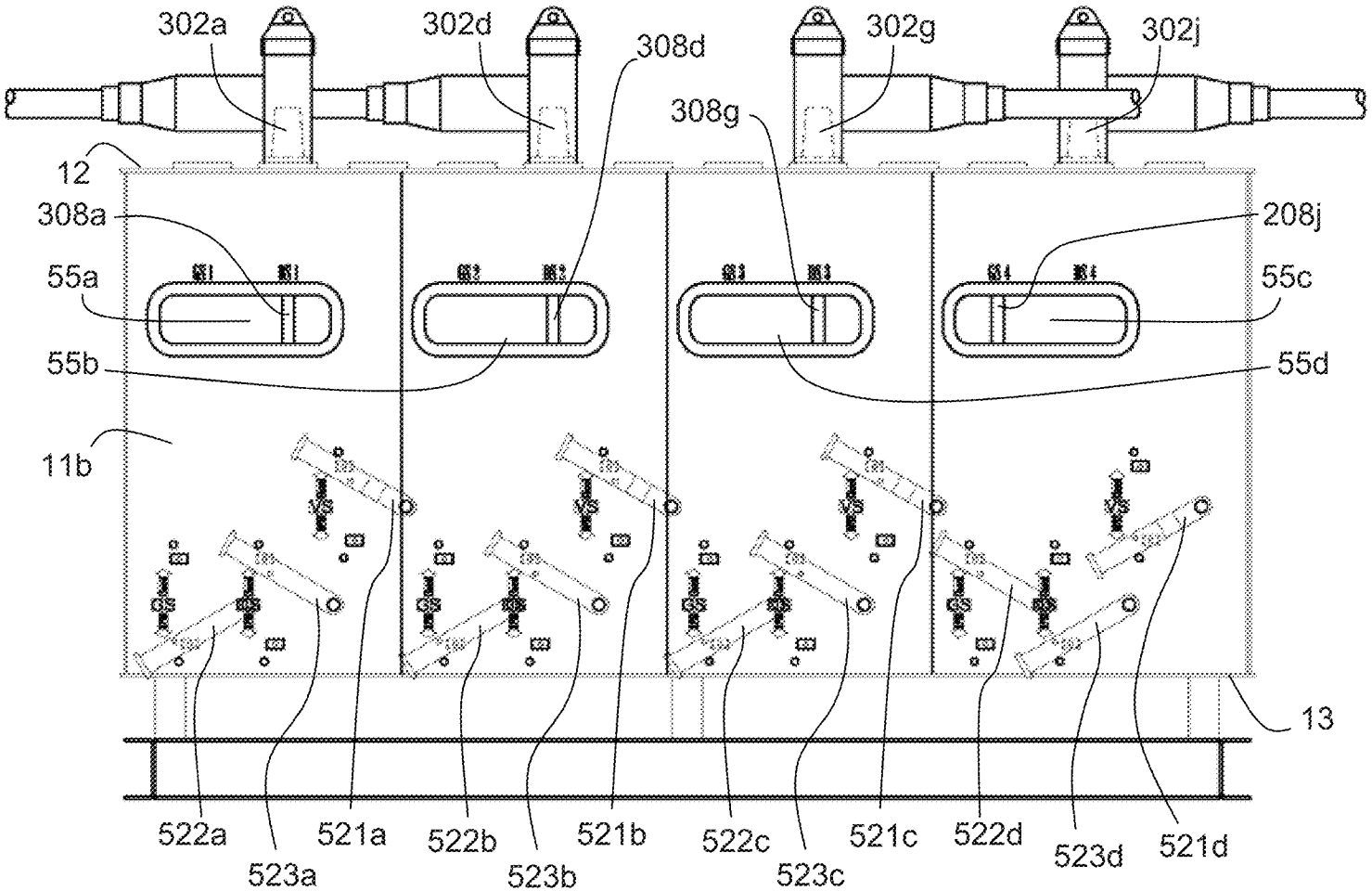
FIG. 16 is a front elevation view, in schematic, of the three-phase, four-way submersible loadbreak vacuum interrupter switchgear with internal ground switch of FIG. 14, illustrating the attachment of power cables.
Figure 17:
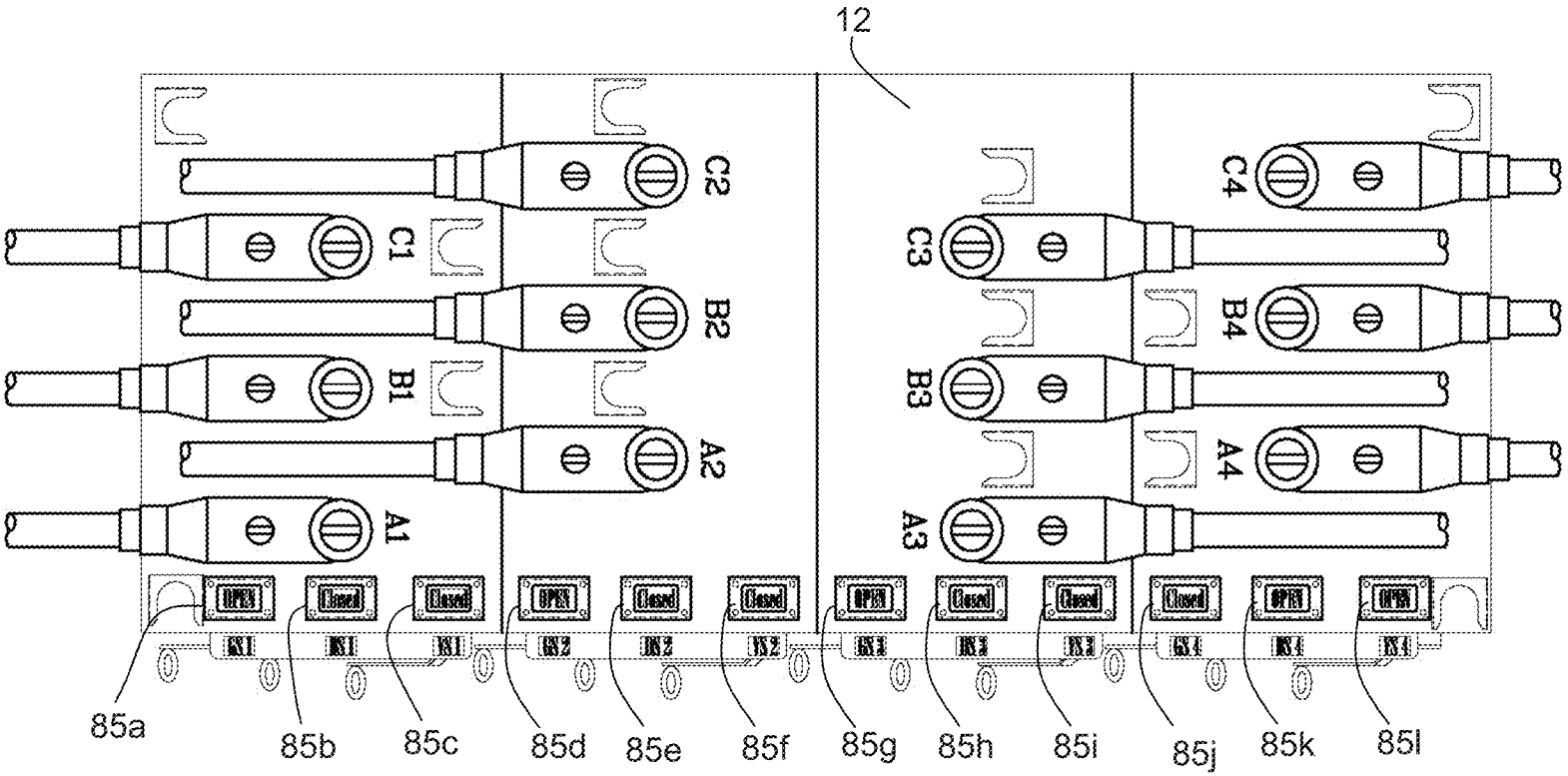
FIG. 17 is a top elevation view, in schematic, of the three-phase, four-way submersible loadbreak vacuum interrupter switchgear with internal ground switch of FIG. 15, illustrating the attachment of power cables.

FIGS. 16 and 17 are front and top elevation view, respectively, in schematic, of the three-phase, four-way submersible loadbreak vacuum interrupter switchgear with internal ground switch of FIG. 14, illustrating the attachment of power cables onto power bushings 302*a-l* which provide power to the switchgear and out to branch circuits. Any ABC set of power cables can be used as the incoming three-phase power feeder with the remaining sets used to distribute three-phase power to branch circuits.

Referencing FIGS. 12 and 13, the electrical flow will be described using three-phase building block 900*a* as the power input and three-phase building blocks 900*b*, 900*c*, and 900*d* as the power outputs for distribution to the branch circuits. As shown in FIGS. 12, 900*a*, 900*b*, and 900*c* are in the closed position and 900*d* is in the open position. Electricity enters 900*a* through power bushings 302*a-c* and into vacuum interrupter bottle assemblies 100*a-c* though connection bus 145*a-c*. The electricity travels to 900*b*, 900*c*, and then 900*d* through connection buses 145*a-c*, 145*d-f*, and 145*g-i*, respectively. In 900*b* and 900*c*, electricity passes through vacuum interrupter bottles 108*d-f* and 108*g-i* and out through disconnect switch assemblies 302*d-f* and 302*g-i* via connection buses 145*d-f* and 145*g-i*, respectively. Electricity does not pass through 900*d* since vacuum interrupter bottles 108*j-l* are open.

Interlocking operating mechanisms are utilized to ensure proper operating procedures when switch assemblies within the switchgear are opened or closed. Referring initially to FIG. 1, operating handles 521*a*, 522*a* and 523*a* have previously been described as having "open" and "closed" positions wherein the open positions preferably have the operating handles pointed in a downward "8 o'clock" direction, while the closed positions have the operating handles pointed in a "10 o'clock" direction, with the operating handles being rotated in a clockwise direction to change from the open to closed position and in a counterclockwise direction to change from the closed to open position.

Figure 18:
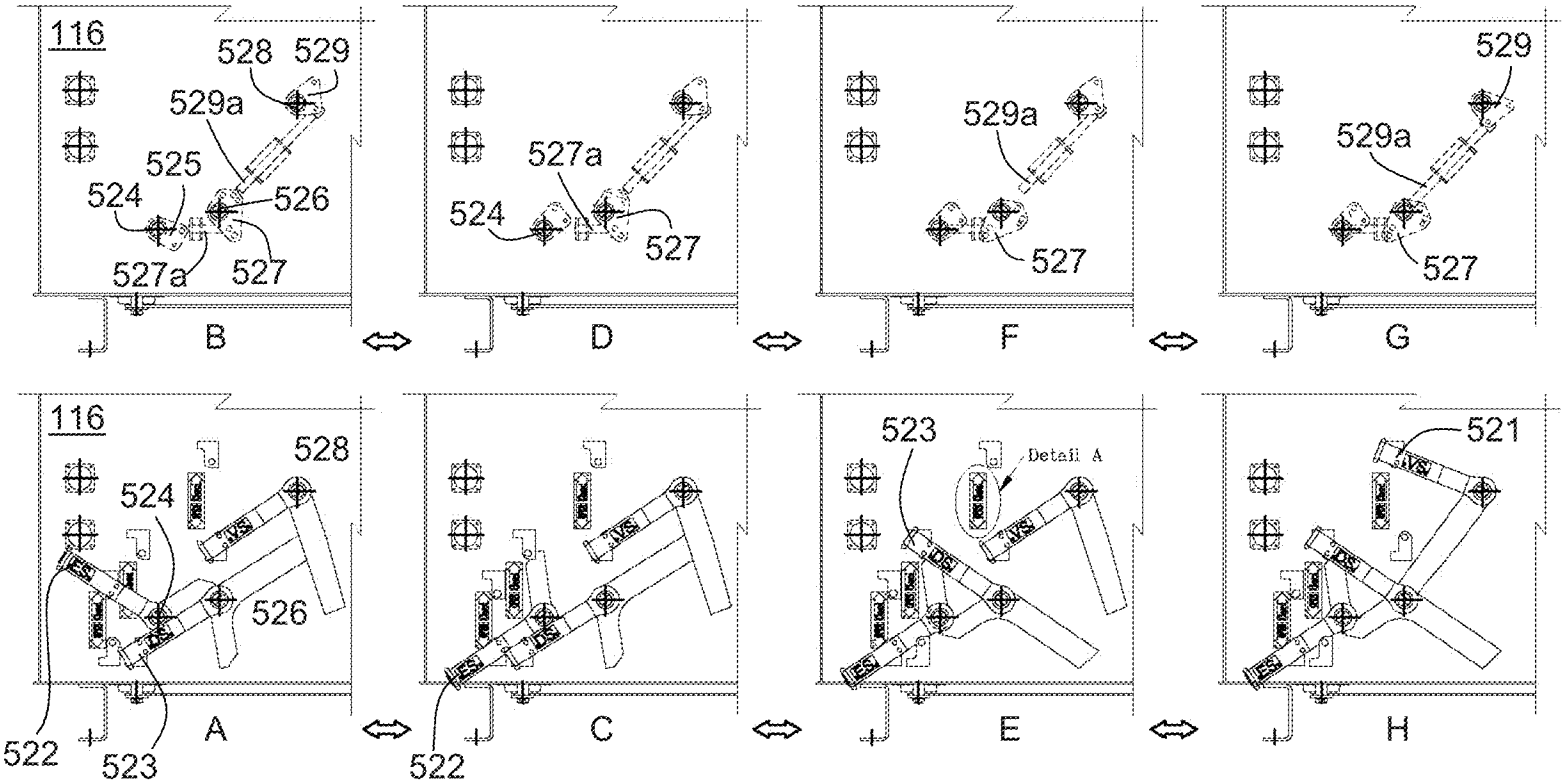
FIGS. 18A-H are schematic illustrations of the operating handles' preferred interlocking mechanism for ensuring proper opening and closing of the switch assemblies within the switchgear.

Operating handles 522*a*, 523*a* and 521*a* are operatively coupled to the ground switch assembly, vacuum bottle switch assembly, disconnect switch assembly and vacuum bottle switch assembly, respectively, of block 900*a*. Likewise, 522*b*, 523*b* and 521*b* are operatively coupled to the ground switch assembly, vacuum bottle switch assembly, disconnect switch assembly and vacuum bottle switch assembly, respectively, of block 900*b*, etc. FIG. 18A schematically illustrates the positions of the operating handles at the front 11*b* of the switchgear case 10 when the block 900*a*, 900*b*, 900*c*, 900*d* is non-conducting, as it would be prior to access for maintenance or during installation and set-up. Since the position and operation of corresponding operating handles is the same from block to block, the letter suffix of each numeric identifier is omitted for brevity.

With the handle 522 in its "closed" 10 o'clock position, the ground switch assembly is closed in order to shunt any residual current to ground. Disconnect switch handle 523 and vacuum bottle switch handle 521 are both in the "open" 8 o'clock position, and the switch assemblies to which they are linked are accordingly in their open-circuit positions.

FIG. 18B schematically illustrates the relevant linkages behind the front 11*b* of the switchgear case 10 for the handle positions of FIG. 18A. Ground switch handle 522 rotates about axis 524 as illustrated in FIG. 18A, and FIG. 18B illustrates a clevis 525 that rotates about axis 524 on the back side of front surface 11*b* in response to the handle rotation.

Likewise, a clevis 527 (FIG. 18B) rotates about axis 526 when the disconnect switch handle 523 (FIG. 18A) rotates about axis 526. A pin 527*a*, however, extends from disconnect switch clevis 527 to contact ground switch clevis 525 in such a way, when the handles are in the illustrated position, that disconnect switch handle 523 is prevented from rotating into its "closed" position when the ground switch handle is in its closed position and the ground switch assemble is thereby closed. Similarly, a pin 529*a* extends from a clevis 529 coupled to the vacuum bottle switch handle 521 for rotation therewith around axis 528, so as to contact disconnect switch clevis 527 and prevent the vacuum switch handle 521 from being rotated to its "closed" position (to thereby close the vacuum bottle switch) when the disconnect switch handle is in its "open" position. Thus, it is not possible to close the disconnect switch or the vacuum bottle switch when the ground switch is closed, and no current can accidentally be permitted to flow into and through the block and be short-circuited to ground. Such a short circuit could result in a huge and dangerous current flow. Similarly, it is not possible to close the disconnect switch assemblies after the vacuum switch assemblies have been closed, or to open the disconnect switch assemblies while the vacuum switch assemblies are closed, thereby preventing arcing across the electrical contacts of the disconnect switches that might occur if the disconnect switch assemblies were switching power current on or off in an otherwise completed circuit. Consequently, such switching occurs within the relatively safe confines of the vacuum bottle switch assemblies.

Turning to FIGS. 18C and 18D, the ground circuit handle 522 has been moved to its "open" 8 o'clock position, thereby rotating clevis 524 away from pin 527*a*. With the ground switch assembly now open, the disconnect assembly switch can be safely closed, as illustrated next in FIGS. 18E-F. With disconnect switch handle rotated into its "closed" 10 o'clock position, disconnect switch clevis 527 is rotated away from pin 529*a* to thereby permit rotation of vacuum bottle switch clevis.

As next illustrated in FIGS. 18H-G, the rotation of the vacuum bottle switch handle to its "closed" 10 o'clock position, and the consequential rotation of its clevis 529, causes pin 529*a* to once again contact disconnect switch clevis 527 in such a way that the disconnect switch handle cannot be rotated to its "open" position while the vacuum bottle switch is closed.

As a result of all of the foregoing, the only way the block 900 can be open circuited is the safest way: its vacuum bottle switch, followed by its disconnect switch, followed by the closing of its ground switch. Conversely, the block can only be activated the safest way: opening the ground switch, followed by closing the disconnect switch, followed by closing the vacuum bottle switch. In addition, the rods of the ground switch and disconnect switch are visible through the viewing window 55 when the respective switch is closed for visual confirmation of same.

Because the state of the vacuum bottle switch assembly prevents the disconnect switch assembly from making or breaking an active circuit, no arcing can occur across the electrical contacts of the disconnect switch; accordingly, the transparent shield is not mandatory, but is highly preferred as a safety precaution in any event. The ground switch assemblies, on the other hand, do not need transparent insulating shields in the preferred embodiment because the contact rod is permanently connected to ground.

Those skilled in the art will recognize that other type of shaft movement may be utilized besides shaft rotation as described above. For example, the mechanisms can be configured to permit one or more of the handles of each building block to be pushed or pulled to thereby selectively engage more than one driven clevis with a single handle-driven shaft. Similarly, structures other than a clevis can be used, and a structure other than a pin can provide blocking. This is all within the knowledge and ability of mechanical designers, and within the scope of the invention.

Further, it may be desirable to replace each of the illustrated viewing windows 55 with two smaller windows that are each sized and positioned to permit the view of only a respective one of the two rods. This alternative configuration may better focus the attention of installation and maintenance personnel on the presence or absence of an expected rod since the presence or absence of the rod will be more apparent with a narrowed more targeted view for a single item.

Although the present invention and its advantages have been described in detail, it should be understood that various changes, substitutions and alterations can be made herein without departing from the spirit and scope of the invention defined by the appended claims.

We claim:

1. A 3-phase multiway vacuum interrupter switch assembly comprising:

(a) a housing having a plurality of windows; and (b) a plurality of building block assemblies within said housing, each building block assembly comprising three disconnect switch assemblies, three vacuum bottle switch assemblies and three ground switch assemblies, each disconnect switch assembly of each block assembly including (1) a power connector extending through the housing, (2) first and second electrical contacts spatially separated from each other, one of said contacts being electrically connected to the power connector, at least a portion of the region between the contacts being viewable through a respective window, (3) a contact rod movable between the first and second contacts to selectively electrically couple and decouple the first and second contacts, at least a portion of the contact rod extending between the first and second contacts being sufficiently viewable through a window to visually signify whether the contact rod is electrically coupling or not electrically coupling the first and second contacts, the control rods of each of said disconnect switch assemblies being connected so that the plurality of disconnect switch control rods move in unison, each of the vacuum interrupter bottle switch assemblies including (1) a substantially stationary electrical contact and (2) a movable electrical contact movable between the first and second positions to selectively electrically couple to and electrically decouple from the substantially stationary electrical contact to thereby respectively close and open-circuit the vacuum interrupter bottle switch assembly, the movable electrical contacts of each vacuum interrupter bottle switch assembly in the block assembly being mechanically linked so that said plurality of movable electrical contacts move in unison, each of said vacuum interrupter bottle switch assemblies being connected in electrical series with a respective one of the internal disconnect switch assemblies, the plurality of vacuum interrupter bottle switch assemblies being functionally coupled to the plurality of internal disconnect switch assemblies so that electrically coupled disconnect switch contacts cannot become electrically decoupled or electrically coupled unless the bottle switch contacts are electrically decoupled, each of said ground switch assemblies having a first electrical contact and a second electrical contact selectively electrically coupled to and electrically decoupled from each other, one of said contacts being electrically coupled to a ground connector extending from the housing for connection to an electrical ground point external to the housing, the other contact being electrically coupled to a respective one of the disconnect switch assemblies in such a way as to couple residual electrical current within the building block to the ground connector when the ground switch assembly contacts are electrically coupled and the contacts of the disconnect switch assembly to which it is electrically coupled are electrically decoupled, the plurality of ground switch assemblies in the block being functionally coupled to the plurality of internal disconnect switch assemblies in the block in such a way that that the contacts of the ground switch assemblies cannot be electrically coupled unless the contacts of the disconnect switch contacts to which they are electrically coupled have been electrically decoupled, and the contacts of the disconnect switches in the block cannot be electrically coupled unless the contacts of the come electrically decoupled or electrically coupled unless the bottle switch contacts are electrically decoupled.

2. The vacuum interrupter switch assembly of claim 1 including a visually transparent insulating shield extending along and around at least a portion of the region between the first and second contacts of each disconnect switch assembly so that the contact rod is sufficiently viewable through the insulating shield and said window to visually signify whether the contact rod is electrically coupling or not electrically coupling the first and second contacts.

3. The vacuum interrupter switch assembly of claim 1 wherein the first and second electrical contacts of each ground switch assembly are spatially separated from each other, one of said contacts being electrically connected to a contact of a respective disconnect switch assembly, at least a portion of the region between the contacts being viewable through a respective window, and each ground switch assembly includes a contact rod movable between the first and second contacts to selectively electrically couple and decouple the first and second electrical contacts, at least a portion of the contact rod being sufficiently viewable through a window to visually signify whether the contact rod is electrically coupling or not electrically coupling the first and second contacts, the control rods of each of said ground switch assemblies being connected so that the plurality of ground switch control rods move in unison.

4. The 3-phase multiway vacuum interrupter switch assembly of claim 1 wherein the interior of the case is substantially free of oil and $SF_6$ gas.

5. The vacuum interrupter switch assembly of claim 1 including interlocking operating mechanisms for ensuring proper operating procedures when switch assemblies within the housing are opened or closed, said operating mechanisms including a plurality of first shafts associated with respective building blocks of switch assemblies within the housing, each first shaft being coupled to the movable contacts of the vacuum bottle switch assemblies in the respective building block and having a manually engagable end portion accessible from the exterior of the case for manually electrically coupling and electrically decoupling the interrupter bottle switches' contacts via shaft movement;

a plurality of second shafts associated with the respective building blocks of switch assemblies within the housing, each second shaft being coupled to the disconnect switch assembly control rods within the respective building block and having a manually engagable end portion accessible from the exterior of the case for manually electrically coupling and electrically decoupling the first and second contacts of the disconnect switch assemblies via shaft movement;

a plurality of third shafts associated with the respective building blocks of switch assemblies within the housing, each third shaft being coupled to the ground switch assemblies within the respective building block, and having a manually engagable end portion accessible from the exterior of the case for manually electrically coupling and electrically decoupling the first and second contacts of the ground switch assemblies via shaft movement;

a plurality of first blocking surfaces positioned with respect to the first and second shafts of the building blocks to prevent the electrical contacts of the vacuum bottle switch assemblies in each building block from becoming electrically coupled if the first and second electrical contacts of the disconnect switch assemblies in that building block are electrically uncoupled, and to prevent the first and second electrical contacts of the disconnect switch assemblies in that building block from becoming electrically uncoupled if the electrical contacts of the vacuum bottle switch assemblies in that building block are electrically coupled; and a plurality of second blocking surfaces positioned with respect to the second and third shafts of the building blocks to prevent the electrical contacts of the ground switch assemblies in each building block from being electrically coupled if the first and second electrical contacts of the disconnect switch assemblies in that block are electrically coupled, and to prevent the first and second electrical contacts of the disconnect switch assemblies in that block from being electrically coupled if the electrical contacts of the ground switch assemblies in that building block are electrically coupled.

* * * * *